United States Patent [19]

Sansome et al.

[11] Patent Number: 4,983,427

[45] Date of Patent: Jan. 8, 1991

[54] SPRAY DEPOSITING OF METALS

[75] Inventors: Dennis H. Sansome, Sutton Coldfield, England; Alfred R. E. Singer, Swansea, Wales

[73] Assignee: National Research Development Corporation, London, England

[21] Appl. No.: 456,584

[22] Filed: Dec. 29, 1989

Related U.S. Application Data

[63] Continuation of Ser. No. 210,414, Jun. 21, 1988, abandoned.

[30] Foreign Application Priority Data

Jun. 26, 1987 [GB] United Kingdom ..... 8715035

[51] Int. Cl.[5] ..... B05D 1/08; B05D 3/12

[52] U.S. Cl. ..... 427/347; 427/422; 427/423; 118/57; 164/71.1; 164/260; 164/416; 164/478; 164/501

[58] Field of Search ..... 118/57; 427/422, 423, 427/347; 239/82; 164/478, 501, 71.1, 260, 416

[56] References Cited

U.S. PATENT DOCUMENTS

| | | | |
|---|---|---|---|
| 1,318,740 | 10/1919 | Fessenden | 164/501 X |
| 2,370,341 | 6/1943 | Bowes | 164/478 X |
| 2,763,040 | 9/1956 | Korb | 164/478 X |
| 3,078,527 | 2/1963 | Valyi et al. | 164/478 X |
| 3,670,400 | 6/1972 | Singer | 29/527.5 |
| 4,066,117 | 1/1978 | Clark | 427/422 |
| 4,204,011 | 5/1980 | Tanabe et al. | 427/57 |
| 4,498,518 | 2/1985 | Hasebe et al. | 164/478 X |
| 4,582,117 | 4/1986 | Kushnick | 164/71.1 |
| 4,614,436 | 9/1986 | Setterberg | 164/71.1 X |

FOREIGN PATENT DOCUMENTS

| | | | |
|---|---|---|---|
| 0139901 | 5/1985 | European Pat. Off. . | |
| 56-56770 | 5/1981 | Japan | 164/71.1 |
| 56-156745 | 12/1981 | Japan | 427/57 |
| 60-49856 | 3/1985 | Japan | 164/71.1 |
| 1262471 | 2/1972 | United Kingdom . | |
| 1599392 | 9/1981 | United Kingdom . | |
| 2172825 | 10/1986 | United Kingdom . | |

OTHER PUBLICATIONS

Soviet Inventions Illustrated, Section CH, Week 8446, Jan. 2, 1985.

"How the Russians Are Using Ultrasonics in Metallurgy" *Report from the U.S.S.R.*, Tesmen, pp. 79–83, 1/1961.

*Primary Examiner*—Shrive Beck

*Attorney, Agent, or Firm*—Cushman, Darby & Cushman

[57] ABSTRACT

On spray-forming metals onto a substrate from which the sprayed coating is to be detached, unwanted adhesion may occur, even to a smooth substrate. Conversely, if the coating is meant to adhere, it may accidentially delaminate, even from a roughened substrate.

By vibrating the substrate, marginally adherent splats will be encouraged to detach themselves while, on the other hand, well adherent splats will not be affected.

18 Claims, No Drawings

SPRAY DEPOSITING OF METALS

This is a continuation of Application Ser. No. 07/210,414, filed June 21, 1988 now abn.

This invention relates to the spray depositing of metals, with a view to forming products of high integrity.

Several techniques and procedures, known generically as "spray forming", have been developed in recent years for producing a wide range of products by spray deposition.

Spray forming normally comprises atomising a source of liquid metal by gas or other means and directing the spray onto a cool substrate, so forming a frozen spray-deposited product which may either be detached from the substrate or remain permanently attached to it. The process is usually carried out in a protective atmosphere to avoid oxidation of the product. In the case of gas atomising, the gas used is usually neutral or reducing and provides the protective atmosphere. In many cases, hot or cold working is carried out on the spray deposit either immediately afterwards whilst still in a controlled atmosphere, or subsequently.

One of the problems in spray forming is that the individual liquid splats produced by the atomised droplets impacting earlier solidified splats do not always completely fill surface irregularities existing on the surface of those earlier solidified splats. The spray deposit may hence be porous, which may not be desirable.

An even more important problem may occur when spray-depositing metals onto a substrate from which the deposit is required to be detached. In this case the surface of the substrate is usually of a material which will not be wetted by the sprayed metal. Such a material might be a thin oxide film such as a chromium oxide film on stainless steel. Although this will effectively prevent metallurgical bonding of the deposit, it will have little effect on mechanical bonding promoted by surface roughness. Mechanical bonding may be lessened by using a smoother substrate surface.

Unfortunately the use of a very smooth or polished non-wetting substrate surface introduces other difficulties. Individual splats shrink as they solidify, and on a very smooth substrate will curl up and slide freely over the substrate surface. When further splats are deposited on top of the first layer the final result is a very rough "orange peel" effect on the deposit surface next to the substrate. This phenomenon is described in a paper entitled "The Principles of Spray rolling of Materials", Metals & Materials, June 1970, pp 246–257, and in British Patent No. 1262471.

The conventional solution to this problem is to use a substrate the surface of which is slightly roughened such that the splats stay in the positions where they fall, i.e. are anchored in position, yet can still be separated from the substrate subsequently without damaging the deposit or leaving pieces of deposit on the substrate. The difficulty in this case is to ensure that the critical degree of roughening of the substrate necessary to achieve both these features is attained.

The invention in a first aspect is a process for spray forming metal products, characterized in that the substrate onto which the spray is directed is vibrated such that the liquid spray particles do not wet the substrate and form a deposit which is easily detached from it.

The invention in a second aspect is a process for spray forming metal products, characterized in that the substrate onto which the spray is directed is vibrated such that the liquid spray particles wet the substrate or an earlier spray-deposited layer on the substrate and form an adherent deposit.

The vibration may be either in the plane of the substrate or in the direction of the axis of the spray or in a resultant direction; that is, the vibration may be the sum of two or more vibrations in different directions, such as a 'diagonal' straight line or a gyration in for example a circular, elliptical or Lissajou path, irrespective of other relatively minor vibration(s) or of any relatively slow bodily motion of the substrate.

The use of such a vibratory (or gyratory) motion eases the problems of attaining precisely a critical degree of roughening of the substrate by decreasing adhesion to the substrate when adhesion is marginal because the deposit will then shake loose. But, whichever of the two aspects of the invention applies, vibration will not affect adhesion of the later splats to the deposit formed by earlier splats because adhesion (i.e. cohesion of the deposit) of splats to each other is always good.

It will be appreciated that a major vibration in a direction within the plane of a substrate (which for the purpose of this explanation is assumed to be flat) has associated with it minor vibrations in the two perpendicular directions to the first-mentioned direction, according to Poisson's ratio. These minor vibrations are in no way detrimental to the effects described above. Similarly, if the main vibration is in the direction of the axis the associated minor vibrations in the two perpendicular directions are not detrimental.

Various exemplary instances of the invention will now be discussed.

If it is required to make a spray-formed product which can be detached from the substrate after replicating the shape of the substrate, the following procedure is followed within the scope of the invention. For example, if a strip of aluminium alloy is to be produced by directing the spray onto a flat water-cooled metal base from which it is detached continuously, the following procedure can be adopted. The member onto which the spray is directed to form the first layer of splats constitutes the substrate. This substrate is maintained in a condition such that the droplets of spray will not wet the surface of the base, i.e. the contact angle is greater than 90°. This may be accomplished in several ways. One way is to ensure that the substrate temperature is well below the melting point of the sprayed metal and that the surface of the base is slightly roughened and is coated with oxide or other ceramic film. For example, the surface of the base may be nitrided, or a stainless steel base may be used which presents a chromium oxide surface to the first layer of splats. In the application of the invention the substrate is given a vibratory motion either in the plane of, or normal to, the plane of the substrate which, combined with the non-wetting characteristics at the deposit/substrate interface, ensures that the deposit separates from the substrate. Once this separation has taken place the vibratory motion transmitted to the deposit is inevitably diminished, while the deposit will continue to grow in thickness as deposition proceeds.

A further benefit can be derived by saw-tooth waveform single-direction vibration of the substrate in the plane of the substrate from which the strip is withdrawn. In this case motion would be slow in the direction of travel of the strip and fast in the reverse direction. Benefit may also be derived from the use of a vibrating wedge inserted between the strip and the substrate up to the line of detachment of the strip. A saw-tooth wave form applied to this wedge, which may be metallic or ceramic (e.g. Sialon), also assists in removing the deposit from the substrate.

The substrate may be flat, as in the above example, or it may be curved or shaped in order to produce continuous lengths of curved or shaped products. A special case is the making of tubular products on a vibrating cylindrical or tapered substrate which may be vibrated either normal to, or in the direction of, the axis of the spray. The substrate may be rotated or not rotated depending on whether the metal spray is unidirectional or multidirectional. Once more there is benefit in using axial vibration having a saw-tooth wave form.

If a thin metal coating is to be produced by spray deposition, to be permanently bonded in a plane to a metal such as a mild steel substrate, measures are taken to ensure that the first layer of splats wet the steel substrate, i.e. that the contact angle is less than 90°. If the depositing splats wet the surface when they are liquid they will generally remain bonded to the surface when solid. Wetting is assisted by ensuring that the substrate surface is effectively free from oxide films, is retained in a neutral or reducing atmosphere and is at a sufficiently high temperature for wetting to take place rapidly. In the example of a thin metal coating, high integrity and density of the coating are ensured by vibrating the substrate. After the first layer of splats has been laid down, this layer becomes the effective substrate which, because of its attachment to the underlying plane, also participates in the vibratory motion. This leads to a high density coating because the later layers of splats will wet the earlier ones of the same composition. This situation will continue until the coating is complete.

A thick metal coating permanently bonded to a metallic substrate or to a prior deposited coating of different chemical composition, i.e. a laminated composite product, could be produced in the same way using the process of the invention.

The plane of the vibration(s), its amplitude(s) and frequency/ies are related to the splatting action of the droplets of molten depositing metal. Typical splats are 500 microns in diameter and 20 microns in thickness although the size varies greatly both within individual sprays and also between sprays used for widely different purposes; thus splats in thin plasma-deposited coatings may be, say, 50 microns in diameter, but in large spray castings made from a melt may be, say, 1 mm in diameter. Vibration is effective both in the plane of the splat and normal to it. The most useful amplitude is necessarily a compromise between amplitude and cost because, for a given frequency, cost increases with amplitude. Typical amplitudes are between 1% and 20% in average splat size, but frequencies are not critical for detachment purposes. For densification purposes the frequency should be high enough for at least one cycle, and preferably several cycles, to occur during the time that the splat is spreading. Times of spreading of splats depend on the impacting velocity of the droplet, size and on the topography of the substrate or prior splat surface. Typical spreading times are less than one millisecond and may be only a few microseconds.

Because of the very wide size range and speeds of droplets in any one spray a compromise amplitude and frequency must always be used but the amplitude will generally be greater and the frequency lower with large average droplet sizes and therefore splat sizes and vice versa. The amplitude that can be achieved will also be much affected by the mass, size, shape and acoustic properties of the member to be vibrated.

A typical useful amplitude is 5 microns and a typical useful frequency is 20 kHz. The range of amplitudes and frequencies used is very wide-ranging, up to 500 microns (e.g. 1 to 100 microns e.g. about 25 microns) and from 100 Hz to 50 kHz respectively. Clearly from the point of view of the energy used and the capital cost of equipment the highest amplitudes are only used with the lowest frequencies, and vice versa. Lower frequencies may be used for detached purposes and may be achieved by mechanical means, i.e. electro-hydraulic, but useful frequencies which avoid major acoustic effects are in the region of 20 kHz which are preferably achieved by piezo-electric or magnetostrictive means. This frequency is particularly useful for separation of a deposit from a substrate and is beyond the audible range. The energy required depends on the size, mass, shape and mode of suspension of the member to be vibrated or gyrated. Far less energy will be used if a natural resonant frequency of the member can be used, perhaps by driving the member with a "tuned" transducer or by suspending or stressing the member so as to ensure that a suitable natural frequency is available.

The vibrational motion imparted to the member is often sinusoidal because of its ease of generation and the natural mode of vibration of elastic members.

Where more than one vibration is applied simultaneously, these remarks may apply to one, some, or all of the vibrations.

An additional benefit of imparting a vibrational motion to a freezing splat is that the grain size is refined. The cause of the grain refinement is the breaking of dendrite arms or tips by the vibration. These arms or tips move to adjacent regions within the freezing splat where they act as nuclei for further solidification. For this purpose high frequencies are required because the time of solidification of a splat is very rapid, often taking only a few milliseconds.

Vibration is believed to improve integrity and density of spray deposits because many splats consist of a liquid front advancing rapidly over either a solid substrate or a solid, or partly solid, prior splat. The effective contact angle at an advancing liquid front is higher than a stationary one because gas molecules at the surface over which the splat is advancing have to be forced out of the way of the advancing liquid front. A retreating liquid front operates in the reverse way and effectively decreases the contact angle. A vibratory motion imparted to the substrate is not transmitted fully to the liquid splat because of the inertia and non-rigidity of the liquid. The motion of the liquid in relation to the substrate is therefore both advancing and retreating with (as the splat spreads) an overall advancing component. The effective contact angle therefore tends towards that at equilibrium, i.e. the effective contact angle at an advancing front is reduced whereby wetting is improved, leading to higher integrity and density.

Such vibratory motion can also be applied to the making of metal matrix particle composites and fibre-reinforced composites by spray co-deposition. In such cases the bond between particles or fibres and the metal matrix is improved and porosity at the interface is diminished.

We claim:

1. A process for forming a metal product by spraying molten metal onto a substrate, characterized in that the substrate onto which the spray is directed is conditioned to have non-wetting characteristics and is vibrated during the spraying to enhance those characteristics and such that the liquid spray particles do not wet the substrate and form a deposit which is easily detached from it.

2. A process according to claim 1, wherein the vibration is in the plane of the substrate.

3. A process according to claim 1, wherein the vibration is in the direction of the axis of the spray.

4. A process according to claim 1, wherein the vibration is the sum of two or more vibrations in different directions.

5. A process according to claim 1 wherein the amplitude of vibration is from 1% to 20% of the average size of a deposited spray particle.

6. A process according to claim 1, wherein the amplitude of vibration is 1 to 100 μm.

7. A process according claim 1 wherein the frequency of vibration is such that at least one cycle occurs during the time between deposition and cessation of spreading of a spray particle.

8. A process according to claim 1, wherein the frequency exceeds $10^2$Hz.

9. A process according to claim 8, wherein the frequency is up to 50kHz.

10. A process for forming a metal product by spraying molten metal onto a substrate, characterized in that the substrate onto which the spray is directed is conditioned to have wetting characteristics and is vibrated during the spraying to enhance those characteristics and such that the liquid spray particles wet the substrate, or an earlier spray-deposited layer on the substrate, and form an adherent deposit.

11. A process according to claim 10 wherein the vibration is in the plane of the substrate.

12. A process according to claim 10 wherein the vibration is in the direction of the axis of the spray.

13. A process according to claim 10 wherein the vibration is the sum of two or more vibrations in different directions.

14. A process according to claim 10 wherein the amplitude of vibration is from 1% to 20% of the average size of a deposited spray particle.

15. A process according to claim 10 wherein the amplitude of vibration is 1 to 100 μm.

16. A process according to claim 10 wherein the frequency of vibration is such that at least one cycle occurs during the time between deposition and cessation of spreading of a spray particle.

17. A process according to claim 10 wherein the frequency exceeds $10^2$HZ.

18. A process according to claim 17 wherein the frequency is up to 50kHZ.

* * * * *